US007749004B2

(12) United States Patent
Shuey

(10) Patent No.: US 7,749,004 B2
(45) Date of Patent: Jul. 6, 2010

(54) ELECTRICAL CONNECTOR HAVING AUTOMATIC LEVER LOCK RELEASE

(76) Inventor: John R. Shuey, 1209 Montrose Cir., Mechanicsburg, PA (US) 17050

( * ) Notice: Subject to any disclaimer, the term of this patent is extended or adjusted under 35 U.S.C. 154(b) by 0 days.

(21) Appl. No.: 12/409,632

(22) Filed: Mar. 24, 2009

(65) Prior Publication Data

US 2009/0246991 A1 Oct. 1, 2009

Related U.S. Application Data

(60) Provisional application No. 61/070,835, filed on Mar. 26, 2008.

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS 6,325,647 B1 * 12/2001 May et al. ..... 439/157

* cited by examiner

*Primary Examiner*—Neil Abrams

(57) ABSTRACT

An electrical connector assembly includes a plug assembly for mating with a header. The plug assembly includes a plug housing and a lever, where the lever includes gear teeth which cooperate with a tooth on the header in a rack and pinion fashion. The lever is locked to the plug housing when the lever is poised for the plug housing to be inserted into the header. A release member on the header releases the lever from the locked position allowing the lever to be rotated to the position where the lever gear teeth mesh with the header tooth, to draw the plug assembly into the header.

15 Claims, 6 Drawing Sheets

ELECTRICAL CONNECTOR HAVING AUTOMATIC LEVER LOCK RELEASE

RELATED APPLICATION

This application claims priority from Provisional application Ser. No. 61/070,835 filed Mar. 26, 2008, the entirety of which is incorporated herein by reference.

This application is related to Provisional application Ser. No. 61/070,836 filed Mar. 26, 2008, now U.S. patent application Ser. No. 12/409,643 filed Mar. 24, 2009.

SUMMARY

The invention is directed to an electrical connector assembly having a plug assembly and a header assembly, and more particularly, where the plug assembly includes a lever which draws the plug assembly into a header upon rotation of the lever.

Electrical connectors having a lever which is rotated to bring the plug assembly into position within a header, find broad use in connector technology, and particularly in automotive technology. The levers have gear teeth which mesh with complementary teeth on the header, in a rack and pinion fashion, to draw the plug assembly into electrical connection with the header.

Typically, the levers include two gear teeth which must be properly oriented to ensure that the lever teeth overlap the tooth on the header. Thus, it is useful if the lever has a detented position relative to the plug housing which properly orients the lever teeth. However, the lever must also be properly released from the plug housing in order to make the connection between the plug and header. These and other improvements have been incorporated and described herein.

In one embodiment, a connector assembly comprises a header having a cavity defined by at least one wall, the wall having a gear tooth positioned on an inner surface thereof. A plug assembly comprises a plug housing and a lever rotatably mounted on the plug housing, where the lever has at least one gear tooth cooperable with the header gear tooth, such that rotation of the lever causes engagement of the header gear tooth and the plug housing gear tooth, drawing the plug member into the cavity. A locking member retains the lever in a fully open position, and a release member releases the locking member.

In another embodiment, a connector assembly comprises a header having a cavity defined by at least one wall, where the wall has a gear tooth and a release member positioned on an inner surface thereof. A plug assembly comprises a plug housing and a lever rotatably mounted on the plug housing, the lever having at least one gear tooth cooperable with the header gear tooth, such that rotation of the lever causes engagement of the header gear tooth and the plug housing gear tooth, drawing the plug member into the cavity. A locking member retains the lever in a fully open position.

In yet another embodiment, a connector assembly, comprises a header having a cavity defined by at least one wall, the wall having a gear tooth positioned on an inner surface thereof. A plug assembly comprising a plug housing and a lever rotatably mounted on the plug housing, the lever having at least one gear tooth cooperable with the header gear tooth, such that rotation of the lever causes engagement of the header gear tooth and the plug housing gear tooth, drawing the plug member into the cavity. Release locking means retains the lever in a locked position, and releases the lever from the locked position, when the plug member is at some insertion position within the header.

An embodiment of the invention will now be described with reference to the following drawings.

DETAILED DESCRIPTION OF EMBODIMENTS OF THE INVENTION

Figure 1:
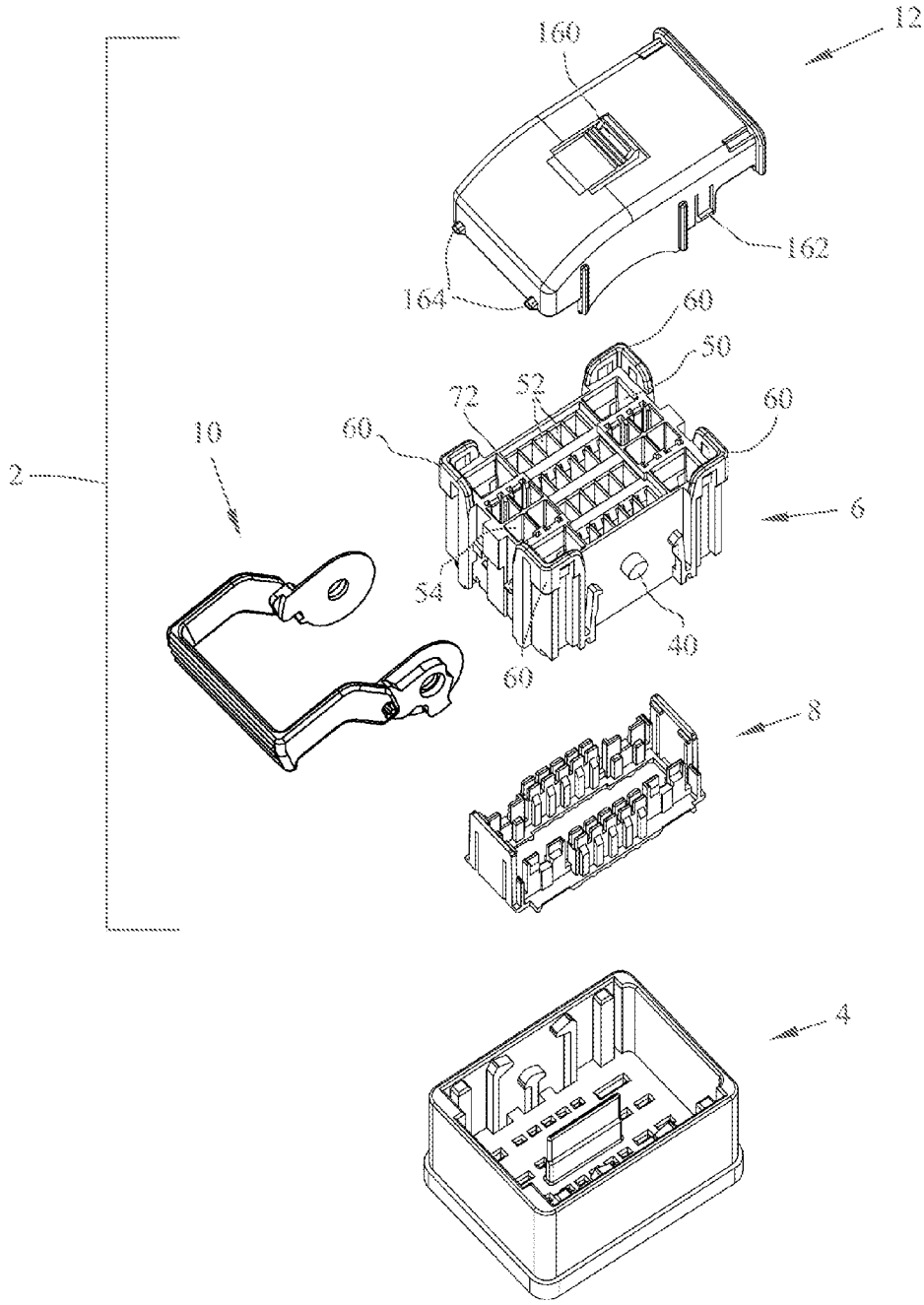
FIG. 1 is an exploded view showing the major components of a plug and header assembly.

Referring first to FIG. 1, a plug assembly 2 is shown in an exploded manner poised for receipt within a header 4. The plug assembly 2 is comprised of a plug housing 6, a terminal position assurance member (TPA) 8, a lever 10 and a wire shroud 12. With the components generally described, the individual components will be described in greater detail.

Figure 3:
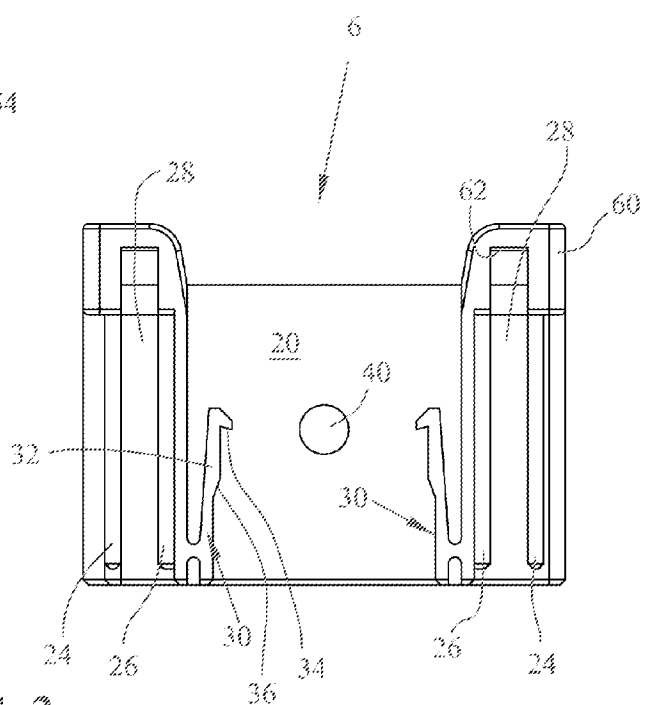
FIG. 3 shows a side plan view of the plug housing of FIG. 2.
Figure 2:
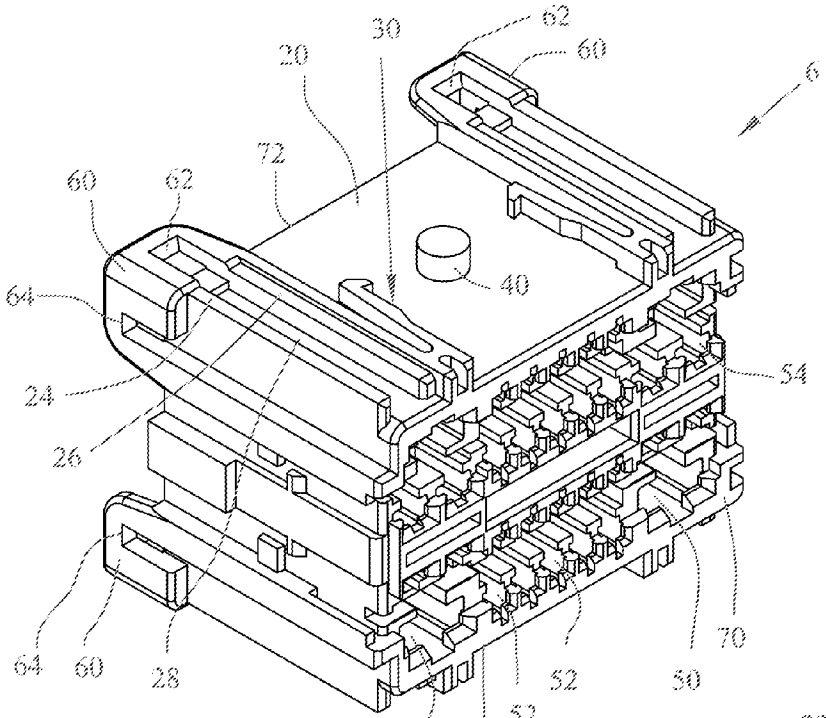
FIG. 2 shows a perspective view of the plug housing.

With reference now to FIG. 2, the plug housing 6 is comprised of sidewalls 20 and 22 where each sidewall includes a pair of ribs 24, 26, defining a channel 28 therebetween. As shown best in FIG. 3, a locking member 30 is positioned inwards of ribs 26 and is defined by a cantilevered arm 32 having a locking pawl 34. Cantilevered arm 32 further includes a cam surface 36 as will be described further herein. Sidewalls 20 each include a pivot mount 40 in the form of a cylindrical pin. As shown in FIGS. 1 and 2, plug housing 6 includes terminal receiving cavities such as 50, 52, and 54. Cavities 50, 52, and 54 would extend generally between a mating face 70 and a terminal receiving face 72. As also shown in FIGS. 1-3, plug housing 6 includes corner posts 60 each defining latching surfaces 62 and 64.

Figure 4:
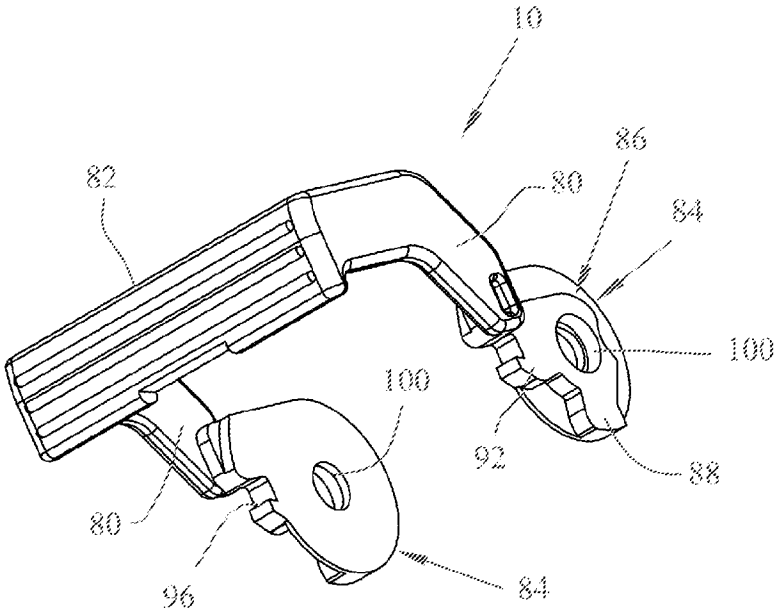
FIG. 4 shows a front perspective view of the lever of FIG. 1.
Figure 5:
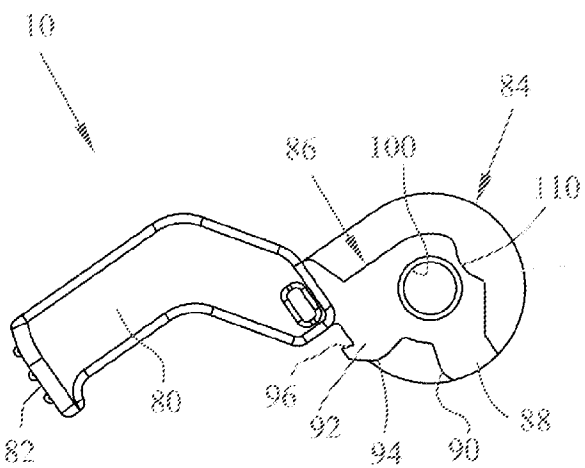
FIG. 5 shows a side view of the lever of FIG. 4.

With reference now to FIGS. 4 and 5, lever 10 will be described. Lever 10 generally comprises two lever arms 80 connected by way of a handle 82 where each lever arm 80 is connected to a central hub 84. Central hub 84 is comprised of a raised portion 86 which includes a first gear tooth 88 having a surface 90 (FIG. 5), a second gear tooth 92 having a surface 94 (FIG. 5) and a locking surface at 96. A central bore 100 extends entirely through the central hub 84 and is profiled to be received over pin 40. As also shown in FIG. 5, raised portion 86 includes a detent surface 110 having cam portion 112 on one side thereof.

Figure 6:
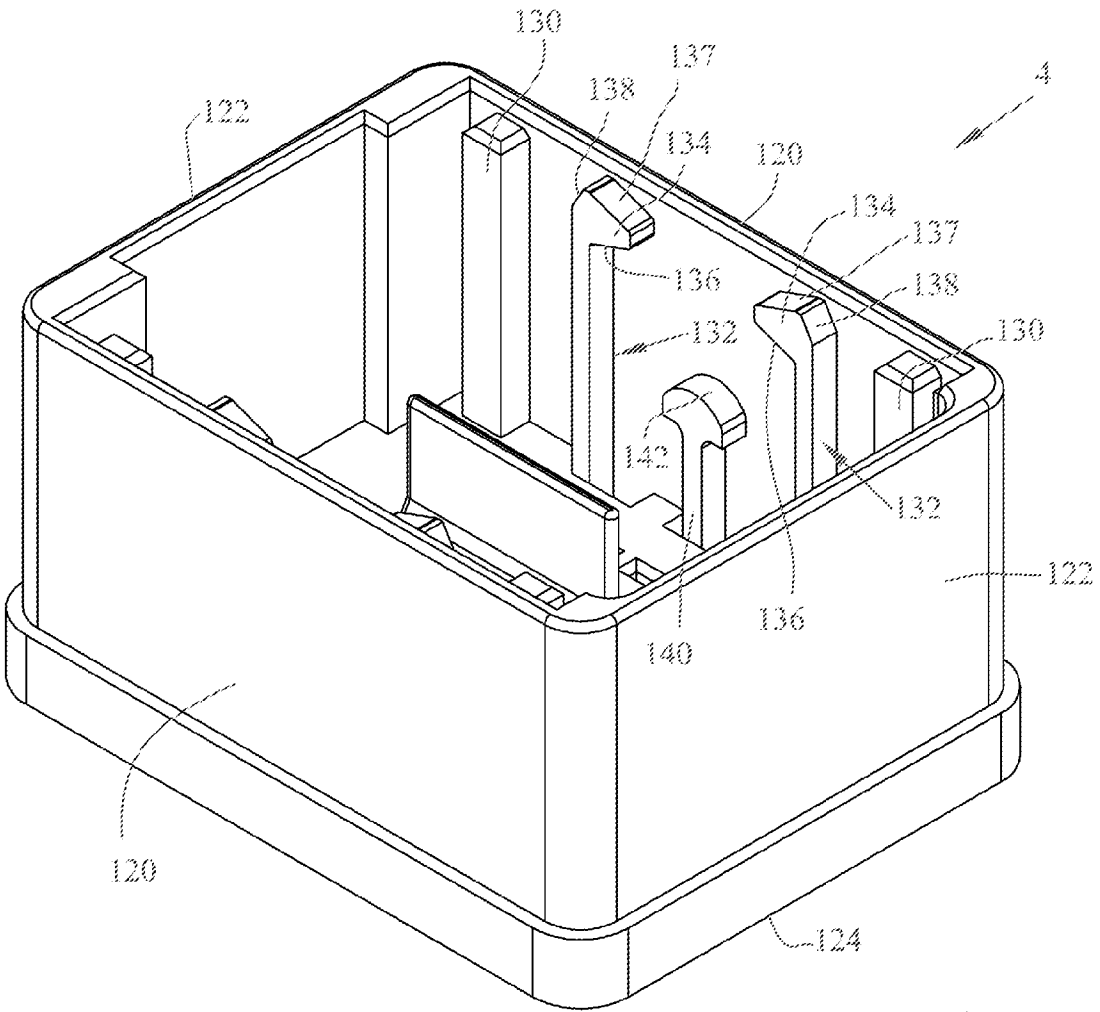
FIG. 6 shows a top perspective view of the header housing.
Figure 7:
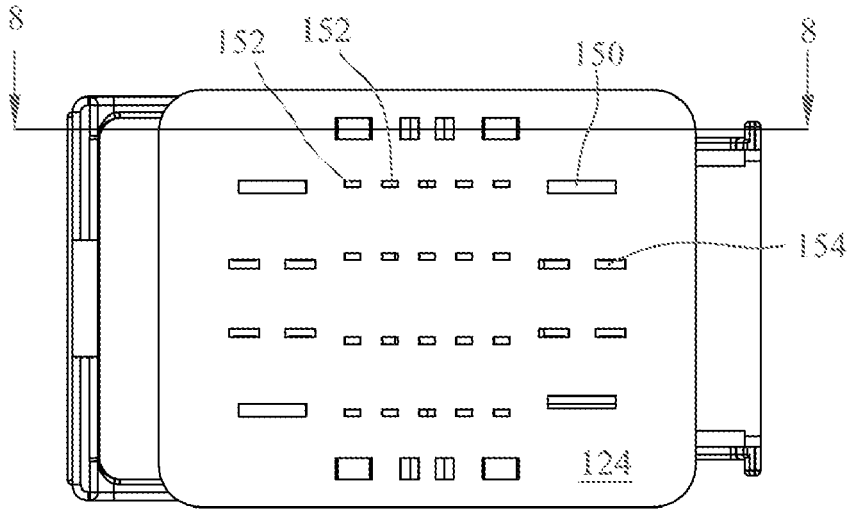
FIG. 7 shows a bottom plan view of the plug assembly positioned within the header assembly.

With respect now to FIG. 6, header 4 will be described in greater detail. Header 4 is comprised of sidewalls 120, end walls 122 and lower base wall 124. The sidewalls define an inner cavity. While Applicants show a rectangular configuration, a single wall of cylindrical configuration could also be used. Each sidewall 120 includes on an inner side thereof polarizing posts 130, drive posts 132 and center posts 140. Each of the drive posts 132 is comprised of a gear tooth 134 having a lower surface 136 and upper surface 137 and a release member defined by release surface 138. Center post 140 includes an upper arcuate surface at 142. Finally as shown in FIG. 7, lower base wall 124 includes large through holes 150 in alignment with terminal passageways 50, apertures 152 in alignment with terminal passageways 52 and apertures 154 in alignment with terminal receiving passageways 54. Apertures 150, 152, and 154 would include pins and/or tabs for interconnection with socket terminals positioned in the apertures 50, 52 and 54 as is well known in the art.

It should be appreciated to those skilled in the art that assembly of the plug assembly 2 as shown in FIG. 1 would include the termination of multiple insulated conductors to multiple socket contacts, and then loading the contacts into the various apertures 50-52. The conductors would be dressed to one side of the housing, and to the right as viewed in FIG. 1. The wire shroud 12 would be snap-latched to the various corner posts 60 of the plug housing 6, by positioning lugs 164 (FIG. 1) against latching surface 64, and latches 162 in and against latching surfaces 62. The TPA 8 will then be snap-loaded into the mating end of plug housing 6 to insure the correct positioning of the various socket terminals. It should also be appreciated that lever 10 is also positionable over pin 40 such that the lever is moveable between positions where the plug assembly 2 may be inserted into header 4, to where the plug assembly 2 is fully locked within the header 4.

Figure 8:
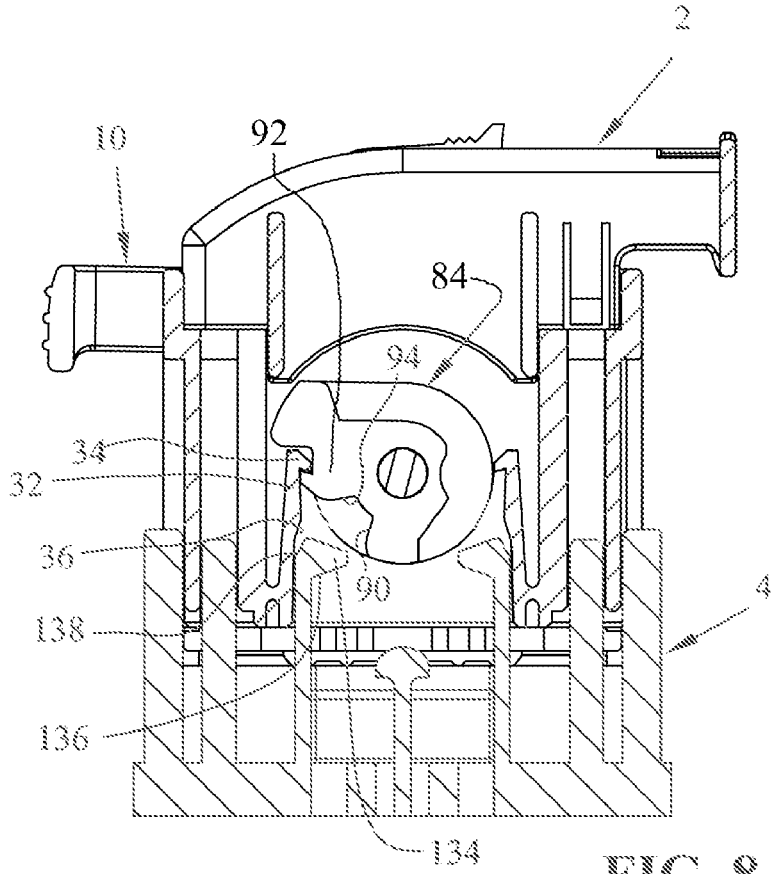
FIG. 8 shows a cross-sectional view through lines 8-8 of FIG. 7.
Figure 9:
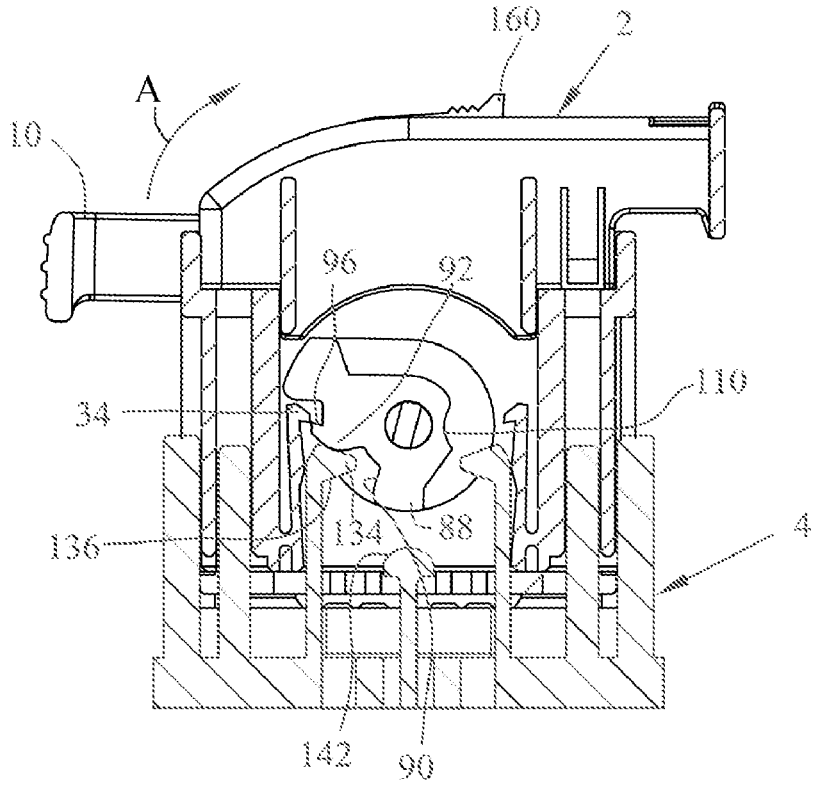
FIG. 9 shows a view similar to that of FIG. 8 where the plug assembly is positioned within the header to the point where the lever lock is tripped.
Figure 10:
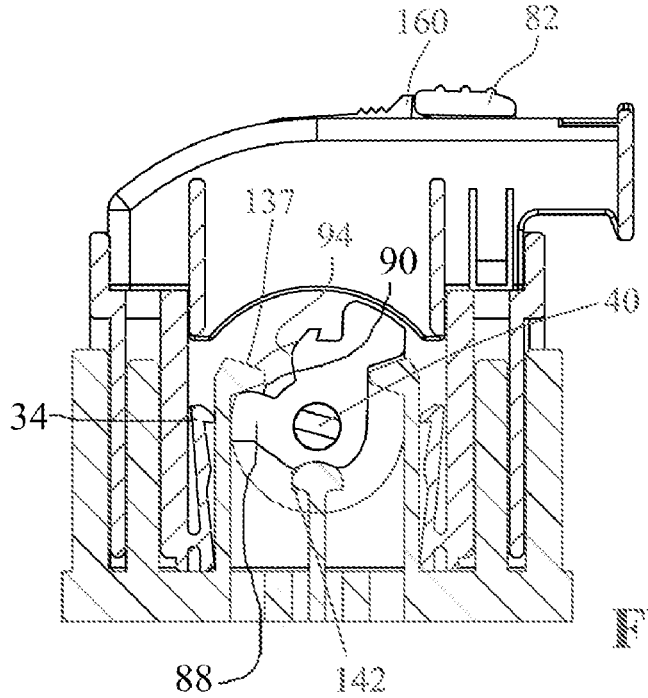
FIG. 10 shows a fully mated condition of the plug assembly and header.

In the embodiment shown, and with particular reference to FIG. 8, lever 10 is shown in the plug assembly insertion position where locking pawl 34 locks against locking surface 96 (FIG. 4) of the central hub 84, and the lever 10 is locked in place in the fully open position. In this position, the first and second gear teeth 88, 92 are in an optimum position such that a receiving area is defined between the tooth surfaces 90 and 94 to receive gear tooth 134 therebetween. In the FIG. 8 position, as plug assembly 2 is presented to the header 4, cam surface 36 approaches release surface 138 such that the cantilever arm 32 deflects open to the position shown in FIG. 9 thereby releasing locking pawl 34 from locking surface 96. In this position, gear tooth 134 is positioned between first and second gear teeth 88 and 92 and clockwise rotation of lever 10 is allowed. Rotation of lever 10, in the direction of arrow A in FIG. 9, will cause tooth surface 90 to engage tooth surface 136. Continued rotation of lever 10 will pull plug housing 2 into header 4, to the position shown in FIG. 10, where detent surface 110 abuts arcuate surface 142. In this position, handle 82 locks in a latch 160 defined in wire shroud 12, as shown in FIG. 10.

What is claimed is:

1. A connector assembly, comprising:

a header having a cavity defined by at least one wall, the wall having a gear tooth positioned on an inner surface thereof;

a plug assembly comprising a plug housing and a lever rotatably mounted on the plug housing, the lever having at least one gear tooth cooperable with the header gear tooth, such that rotation of the lever causes engagement of the header gear tooth and the plug housing gear tooth, drawing the plug member into the cavity;

a locking member for retaining the lever in a fully open position, and being movable along an axis parallel to the at least one wall, from a locked to an unlocked position; and a release member for releasing the locking member.

2. The connector assembly of claim 1, wherein the locking member is located on said plug housing.

3. The connector assembly of claim 2, wherein the lever is comprised of a central hub portion, with the at least one gear tooth arranged adjacent a peripheral edge thereof.

4. The connector assembly of claim 3, wherein said locking member latches to the central hub.

5. The connector assembly of claim 4, wherein said locking member comprises a locking pawl.

6. The connector assembly of claim 5, wherein said locking pawl latches to a latching surface on the central hub.

7. The connector assembly of claim 6, wherein said locking pawl is attached to an end of a cantilevered arm.

8. The connector assembly of claim 7, wherein said cantilevered arm extends from a leading edge of the plug housing.

9. The connector assembly of claim 8, wherein the release member is integral with said header gear tooth.

10. A connector assembly, comprising:

a header having a cavity defined by at least one wall, the wall having a post positioned on an inner surface thereof, the post comprising a gear tooth and a release member;

a plug assembly comprising a plug housing and a lever rotatably mounted on the plug housing, the lever having a central hub having at least one gear tooth positioned thereon and cooperable with the header gear tooth, such that rotation of the lever causes engagement of the header gear tooth and the plug housing gear tooth, drawing the plug member into the cavity; and a locking member for retaining the lever in a fully open position, the locking member engaging a locking surface on the central hub.

11. The connector assembly of claim 10, wherein the at least one gear tooth is arranged adjacent a peripheral edge of the central hub.

12. The connector assembly of claim 11, wherein said locking member is a locking pawl which latches to a latching surface on the central hub portion.

13. The connector assembly of claim 12, wherein said locking pawl is attached to an end of a cantilevered arm.

14. The connector assembly of claim 13, wherein said cantilevered arm extends from a leading edge of the plug housing.

15. A connector assembly, comprising:

a header having a cavity defined by at least one wall, the wall having a gear tooth positioned on an inner surface thereof;

a plug assembly comprising a plug housing and a lever rotatably mounted on the plug housing, the lever being comprised of a central hub and having at least one gear tooth on peripheral edge thereof and cooperable with the header gear tooth, such that rotation of the lever causes engagement of the header gear tooth and the plug housing gear tooth, drawing the plug member into the cavity; and release locking means for retaining the lever in a locked position, and releasing the lever from the locked position, when the plug member is at some insertion position within the header, said release locking means being comprised of a locking pawl located on said plug housing which latches to a latching surface on the central hub for retaining the lever in a fully open position and a release member for releasing the locking member.

* * * * *